US011562683B2

(12) United States Patent
Takahashi

(10) Patent No.: US 11,562,683 B2
(45) Date of Patent: Jan. 24, 2023

(54) LED DRIVING DEVICE

(71) Applicant: TOYODA GOSEI CO., LTD., Kiyosu (JP)

(72) Inventor: Kazuhisa Takahashi, Kiyosu (JP)

(73) Assignee: TOYODA GOSEI CO., LTD., Kiyosu (JP)

( * ) Notice: Subject to any disclaimer, the term of this patent is extended or adjusted under 35 U.S.C. 154(b) by 0 days.

(21) Appl. No.: 17/156,040

(22) Filed: Jan. 22, 2021

(65) Prior Publication Data

US 2021/0241681 A1 Aug. 5, 2021

(30) Foreign Application Priority Data

Feb. 4, 2020 (JP) ..... JP2020-016933

(51) Int. Cl.
*G09G 3/00* (2006.01)
*G09G 3/32* (2016.01)

(52) U.S. Cl.
CPC ..... *G09G 3/32* (2013.01); *G09G 2330/021* (2013.01); *G09G 2330/12* (2013.01)

(58) Field of Classification Search
None
See application file for complete search history.

(56) References Cited

U.S. PATENT DOCUMENTS

2006/0232612 A1* 10/2006 Tsuge ..... G09G 3/3283 345/690
2008/0174544 A1* 7/2008 Ueda ..... G09G 3/3426 345/102

(Continued)

FOREIGN PATENT DOCUMENTS

JP 2005-252211 A 9/2005
JP 2006-119171 A 5/2006

(Continued)

OTHER PUBLICATIONS

Japanese Office Action, dated Dec. 6, 2022, in corresponding Japanese Patent Application No. 2020-016933, with an English Translation thereof.

*Primary Examiner* — Michael A Faragalla

(74) *Attorney, Agent, or Firm* — McGinn I.P. Law Group, PLLC

(57) ABSTRACT

An LED-driving device includes a displaying section including a plurality of displaying groups, each composed of a plurality of connected LED elements, each with a built-in light emission-controlling element, a power-supplying section configured to provide a supply of an electric power to the displaying section, switching sections configured to selectively make or break connections between the power-supplying section and those displaying groups respectively, and a controlling section configured to make a decision as to whether, when the power-supplying section is powered on, an output value from the power-supplying section is normal or not, and as a result of determining that the output value from the power-supplying section is normal, perform such a control of the connections between the power-supplying section and those displaying groups as to enable the switching sections to in turn connect supplies of the electric power from the power-supplying section to those displaying groups, respectively.

20 Claims, 3 Drawing Sheets

(56) References Cited

U.S. PATENT DOCUMENTS

| | | | | |
|---|---|---|---|---|
| 2008/0320182 | A1* | 12/2008 | Rugo | G05B 19/054 710/51 |
| 2010/0177127 | A1 | 7/2010 | Akiyama et al. | |
| 2016/0143107 | A1* | 5/2016 | Kim | H05B 45/44 315/210 |
| 2016/0165689 | A1* | 6/2016 | Li | H05B 45/397 315/210 |

FOREIGN PATENT DOCUMENTS

| | | | |
|---|---|---|---|
| JP | 2010-161264 | A | 7/2010 |
| JP | 2015-079857 | A | 4/2015 |
| JP | 2016-072134 | A | 5/2016 |

* cited by examiner

LED DRIVING DEVICE

CROSS-REFERENCE TO RELATED APPLICATIONS

The present application is based on Japanese patent application No. 2020-016933 filed on Feb. 4, 2020, the entire contents of which are incorporated herein by reference.

TECHNICAL FIELD

The present invention relates to an LED driving device.

BACKGROUND ART

An LED driving device is known that, even when supplying a large electric current to an LED array, can drive that LED array with the constant electric current with no increased mounting area, and which, in addition, is effective not only in steady state operation but also in digital dimming (see, for example, JP 2010/161264 A).

The LED driving device is configured in such a manner as to include therein n vertically structured constant electric current drive elements, each of which is connected in series with each of LED strings, respectively, to drive each of the LED strings with a constant electric current, n constant electric current control circuits, each of which is configured to control an on voltage of each of the n constant electric current drive elements respectively so that an electric current flowing in each of the LED strings becomes a constant electric current, a minimum voltage detecting circuit, which is configured to use each of LED string side terminal voltages of the n constant electric current drive elements as an input, to select a minimum voltage of the LED string side terminal voltages of the n constant electric current drive elements, and output a command signal on the basis of a difference between the selected minimum voltage and a predetermined set voltage, and a power supply control circuit, which is configured to control a voltage to be applied to the LED array so that the voltage to be applied to the LED array is a smaller voltage than an initial set voltage on the basis of the command signal output from the minimum voltage detecting circuit. This makes it possible to deal with even the case in which the LED electric current is sharply changed from the constant electric current to the zero electric current, or from the zero electric current to the constant electric current.

SUMMARY OF INVENTION

In the known LED driving device, if the LED elements are in an abnormal operation due to an influence of heat or the like, a maximum operating mode may be activated that causes all the LED elements to be fully lit. For example, in the LED driving device which is configured in such a manner that a plurality of the LED elements each equipped with a respective built-in light emission controlling element being designed to control the amount and the like of light emitted from the each of the LED elements are connected together in that LED driving device, in the foregoing case of the abnormal operation of the LED elements, immediately after the power supply has been powered on, a large electric current has flowed, and the respective built-in light emission controlling element has failed to be overwritten and reset, which consequently has led to concern that no recovering operation for the LED driving device can be performed. For this reason, there has been a problem with the allowable value (full capacity) of the power supply output in the power supply side being required to be set large.

It is an object of the present invention to provide an LED driving device which is designed to be able to minimize its power supply capacity and thereby allow a lowering in cost.

In accordance with one aspect of the present invention, LED driving devices as defined in [1] to [6] below are provided.

[1] An LED driving device, comprising: a displaying section configured in such a manner as to include a plurality of displaying groups therein, each of which is composed of a respective plurality of connected LED elements, each of which is being configured in such a manner as to include a respective built-in light emission controlling element therein, so that the plurality of constituent displaying groups form a display region; a power supplying section configured to provide a supply of an electric power to the displaying section; switching sections configured to selectively make or break connections between the power supplying section and the plurality of constituent displaying groups, respectively, of the displaying section; and a controlling section configured to make a decision as to whether, when the power supplying section is powered on, an output value from the power supplying section is normal or not, and as a result of determining that the output value from the power supplying section is normal, carry out such a control of the connections between the power supplying section and the plurality of constituent displaying groups of the displaying section as to enable the switching sections to in turn connect supplies of the electric power from the power supplying section to the plurality of constituent displaying groups, respectively, of the displaying section.

[2] An allowable value of a power supply output from the power supplying section may be set as a total value of respective maximum usable electric power values of the plurality of constituent displaying groups of the displaying section.

[3] Further, the respective pluralities of constituent LED elements of the plurality of displaying groups in the displaying section may be configured in such a manner that the respective built-in light emission controlling elements of those constituent LED elements are each being connected across each of those constituent LED elements, to carry out a control of respective light emissions of those constituent LED elements with a serial communication (a serial control).

[4] Further, the switching sections may be configured in such a manner as to use static relays, respectively, to selectively make or break the connections between the plurality of constituent displaying groups, respectively, of the displaying section and the power supplying section.

[5] Further, the controlling section may be configured to monitor an electric current value output from the power supplying section, and make the decision as to whether, when the power supplying section is powered on, the output value from the power supplying section is normal or not, on the basis of the aforesaid monitored electric current value.

[6] Further, the controlling section may be configured to carry out the control of the connections between the power supplying section and the plurality of constituent displaying groups of the displaying section, in a recovery operation after an abnormal operation of the displaying section.

Advantageous Effects of Invention

According to the present invention, it is possible to minimize the power supply capacity and thereby allow a lowering in cost.

DESCRIPTION OF EMBODIMENTS

Embodiment of the Present Invention

Figure 1:
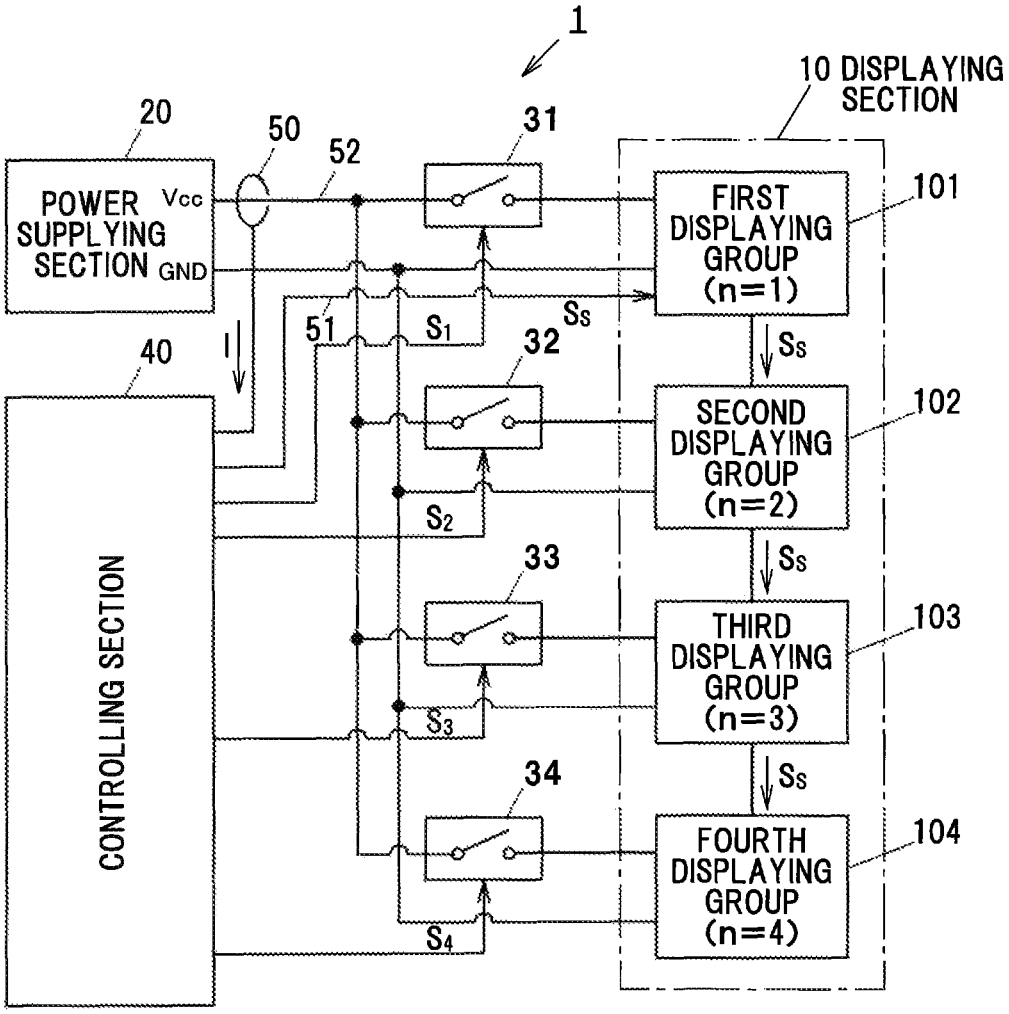
FIG. 1 is a configuration block diagram showing a schematic configuration of an LED driving device according to an embodiment of the present invention.

Configuration of an LED Driving Device According to an Embodiment of the Present Invention As shown in FIG. 1, an LED driving device 1 according to an embodiment of the present invention is being configured in such a manner as to include therein a displaying section 10, which is being configured in such a manner as to include therein a plurality (in the present embodiment, four) of constituent displaying groups 101, 102, 103, and 104 (herein also referred to as the first constituent displaying group 101, the second constituent displaying group 102, the third constituent displaying group 103, and the fourth constituent displaying group 104), each of which is composed of a respective plurality of connected LED elements 5, 5, . . . , 5, each of which is being configured in such a manner as to include a respective built-in light emission controlling element 7 therein, so that the plurality of constituent displaying groups 101, 102, 103, and 104 form a display region, a power supplying section 20, which is being configured to provide a supply of an electric power to the displaying section 10, switching sections 31, 32, 33, and 34, which are being configured to selectively make or break connections between the power supplying section 20 and the plurality of constituent displaying groups 101, 102, 103, and 104, respectively, of the displaying section 10, and a controlling section 40, which is being configured to make a decision as to whether, when the power supplying section 20 is powered on, an output value from the power supplying section 20 is normal or not, and as a result of determining that the output value from the power supplying section 20 is normal, carry out such a control of the connections between the power supplying section 20 and the plurality of constituent displaying groups 101, 102, 103, and 104 of the displaying section 10 as to enable the switching sections 31, 32, 33, and 34 to in turn connect supplies of the electric power from the power supplying section 20 to the plurality of constituent displaying groups 101, 102, 103, and 104, respectively, of the displaying section 10.

The term "in turn connect" recited herein means the connections between the power supplying section 20 and the plurality of constituent displaying groups 101, 102, 103, and 104 of the displaying section 10, which in turn are made by iteratively incrementing the number of constituent displaying groups to be connected to the power supplying section 20 in such a way that the controlling section 40 first enables the switching section 31 to make connection between the power supplying section 20 and the first constituent displaying group 101, and makes a decision as to whether an allowable value of an output from the power supplying section 20 is normal or not, and as a result of making that decision, if the controlling section 40 determines that the allowable value of the output from the power supplying section 20 is normal, then it enables the switching sections 31 and 32 to make connection between the power supplying section 20 and the first constituent displaying group 101, and connection between the power supplying section 20 and the second constituent displaying group 102, respectively, and it makes a decision as to whether an allowable value of an output from the power supplying section 20 is normal or not, and as a result of making that decision, if the controlling section 40 determines that the allowable value of the output from the power supplying section 20 is normal, then it enables the switching sections 31, 32, and 33 to make connection between the power supplying section 20 and the first constituent displaying group 101, connection between the power supplying section 20 and the second constituent displaying group 102, and connection between the power supplying section 20 and the third constituent displaying group 103, respectively, and it makes a decision as to whether an allowable value of an output from the power supplying section 20 is normal or not, and as a result of making that decision, if the controlling section 40 determines that the allowable value of the output from the power supplying section 20 is normal, then it enables the switching sections 31, 32, 33, and 34 to make connection between the power supplying section 20 and the first constituent displaying group 101, connection between the power supplying section 20 and the second constituent displaying group 102, connection between the power supplying section 20 and the third constituent displaying group 103, and connection between the power supplying section 20 and the fourth constituent displaying group 104, respectively. In this manner, finally, all the four constituent displaying groups 101, 102, 103, and 104 of the displaying section 10 are connected to the power supplying section 20. That is, the LED driving device 1 according to the present embodiment is being configured as one equipped with a recovery algorithm as described above, which is being designed to recover the LED driving device 1 from an abnormal operation of the displaying section 10.

In the present embodiment, the number (herein denoted by n) of constituent displaying groups of the displaying section 10 is described as being plural, and as being taken as n=4, i.e. the displaying section 10 is described as being configured in such a manner as to be composed of the four constituent displaying groups 101, 102, 103, and 104, but it is possible to set the number n of constituent displaying groups of the displaying section 10 as any number.

In the LED driving device 1 according to the present embodiment, for example, in the event of an abnormal operation of the respective built-in light emission controlling elements 7, 7, . . . , 7 of the LED elements 5, 5, . . . , 5 in the displaying section 10 due to thermal runaway or the like, all the LED elements 5, 5, . . . , 5 have been operated in a full power operating mode, whereby, immediately after the power supply has been powered on, a large electric current has flowed and, as a result, the capacity of the power supply has failed to keep up with the flow of the electric current, which has led to a failure of the recovering operation for the LED driving device 1. For this reason, the displaying section 10, which acts as an electrical load, is being divided into a plurality of the constituent displaying groups (in the present embodiment, the four constituent displaying groups 101, 102, 103, and 104), each of which is being equipped with a respective static relay for the shutting off of the power supply, so that each of the four constituent displaying groups 101, 102, 103, and 104 in turn is provided with a respective power on/output minimizing command By configuring the displaying section 10 in the foregoing manner, there is no problem with a voltage drop and the like due to a shortage of the capacity of the power supplying section 20, and it is therefore possible to securely carry out the overwrite and reset of the respective built-in light emission controlling elements 7, 7, . . . , 7 of the constituent LED elements 5, 5, . . . , 5, and it is possible to thereby perform the recovering operation to recover the LED driving device 1 from an abnormal operation of the displaying section 10. Also, by employing the above described configuration of the displaying section 10 in the LED driving device 1, it is possible to allow the capacity of the power supplying section 20 not to be large, i.e. allow the allowable value of the output of the power supply (the capacity of the power supply) of the power supplying section 20 to be minimized, and it is possible to thereby allow a lowering in cost as well.

Displaying Section 10

The displaying section 10 is being configured in such a way as to be divided into and be composed of a plurality of the displaying groups. In the present embodiment, the displaying section 10 is being divided into and formed of the four constituent displaying groups (i.e. the first constituent displaying group 101, the second constituent displaying group 102, the third constituent displaying group 103, and the fourth constituent displaying group 104). The displaying section 10 is able to display any moving image, any still image, and the like, by using the controlling section 40 to control the respective brightness, RGB, and the like of each LED element 5 constituting each of the four constituent displaying groups 101, 102, 103, and 104 in the displaying section 10. For example, the displaying section 10 can be used as a signage or a digital signage (also called electronic signboard, or digital signboard). By mounting the displaying section 10 on a vehicle, it is possible to display various types of information. Further, since the displaying section 10 is being configured in such a way as to be composed of a plurality of the divided displaying groups, it is possible to provide a large area display.

Figure 2A:
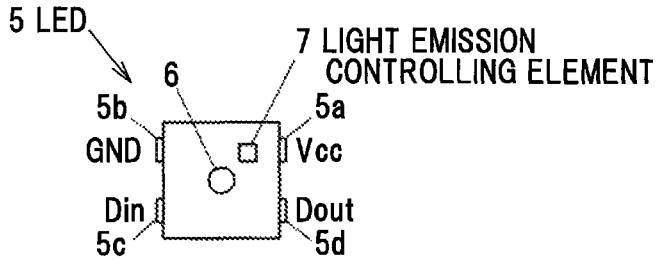
FIG. 2A is a plan view showing a schematic configuration of one LED element.

As shown in FIG. 2A, each of the plurality of constituent LED elements 5, 5, . . . , 5, which are included in each of the four constituent displaying groups 101, 102, 103, and 104 of the displaying section 10, is being configured in such a manner as to include therein a respective light emitting portion 6, which is an LED chip, and a respective light emission controlling element (IC) 7, which is being configured to perform a light emission control on the respective light emitting portion 6. Each of those constituent LED elements 5, 5, . . . , 5 includes a respective power supply connecting terminal (denoted by Vcc terminal in FIG. 2A) 5*a*, a respective ground terminal (denoted by GND terminal in FIG. 2A) 5*b*, a respective control input terminal (denoted by Din terminal in FIG. 2A) 5*c* for the respective built-in light emission controlling element 7, and a respective control output terminal (denoted by Dout terminal in FIG. 2A) 5*d* for the respective built-in light emission controlling element 7.

Figure 2B:
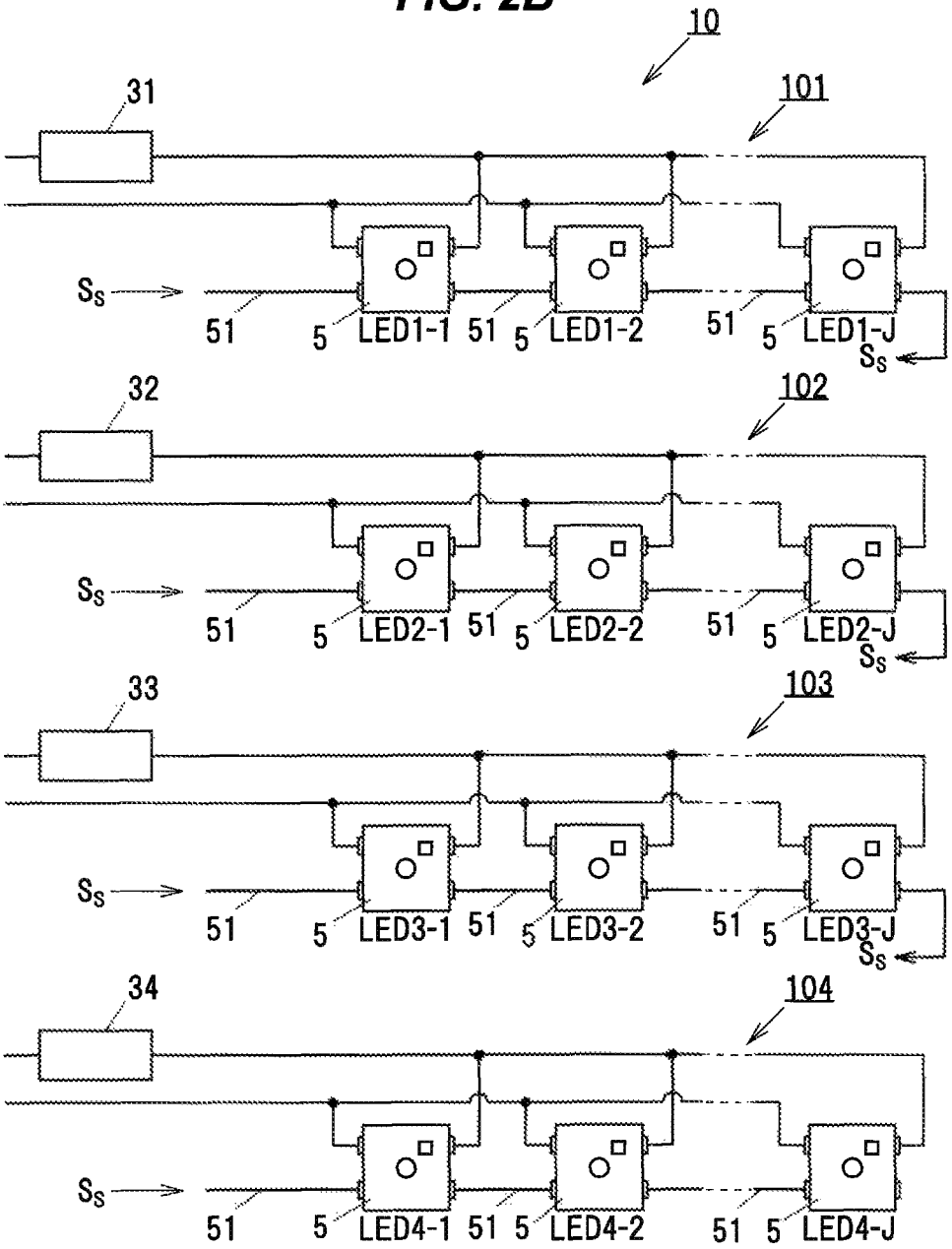
FIG. 2B is a schematic configuration diagram showing a configuration of a displaying section in which LED elements are being connected together to constitute a displaying group, and in which a plurality of the displaying groups are being arranged together in parallel.

As shown in FIG. 2B, the respective Vcc terminals 5*a*, 5*a*, . . . , 5*a* of the constituent LED elements 5, 5, . . . , 5 in each of the four constituent displaying groups 101, 102, 103, and 104 in the displaying section 10 are being connected to a power supply output portion Vcc (see FIG. 1) of the power supplying section 20 with each of the switching sections 31, 32, 33, and 34 between each of the four constituent displaying groups 101, 102, 103, and 104 and the power supplying section 20. The respective GND terminals 5*b*, 5*b*, . . . , 5*b* of the constituent LED elements 5, 5, . . . , 5 in each of the four constituent displaying groups 101, 102, 103, and 104 in the displaying section 10 are being connected to a ground portion GND (see FIG. 1) of the power supplying section 20. Further, in each of the four constituent displaying groups 101, 102, 103, and 104 in the displaying section 10, the respective control input Din terminals 5*c*, 5*c*, . . . , 5*c* of the constituent LED elements 5, 5, . . . , 5 are being connected to the respective control output Dout terminals 5*d*, 5*d*, . . . , 5*d* of the constituent LED elements 5, 5, . . . , 5 being connected immediately therebefore, and the respective control output Dout terminals 5*d*, 5*d*, . . . , 5*d* of the constituent LED elements 5, 5, . . . , 5 are being connected to the respective control input Din terminals 5*c*, 5*c*, . . . , 5*c* of the constituent LED elements 5, 5, . . . , 5 being connected immediately thereafter.

As shown in FIG. 2B, within each of the four constituent displaying groups 101, 102, 103, and 104 in the displaying section 10, the plurality of constituent LED elements 5, 5, . . . , 5 equipped with their respective built-in light emission controlling elements 7, 7, . . . , 7 are being connected together. For the first constituent displaying group 101 in the displaying section 10, an explanation is given. Within the first constituent displaying group 101, for example, a plurality (denoted by J in FIG. 2B) of the constituent LED elements 5, 5, . . . , 5 (also denoted by LED1-1, LED1-2, LED1-J in FIG. 2B) are being connected together in such a manner that their respective Vcc terminals 5*a*, 5*a*, . . . , 5*a* are being connected in parallel with the power supply output portion Vcc (see FIG. 1) of the power supplying section 20 while their respective GND terminals 5*b*, 5*b*, 5*b* are being connected in parallel with the ground portion GND (see FIG. 1) of the power supplying section 20.

Also, within the first constituent displaying group 101 in the displaying section 10, the respective control input Din terminals 5*c*, 5*c*, . . . , 5*c* of the constituent LED elements 5, 5, . . . , 5 are being connected in series with the respective control output Dout terminals 5*d*, 5*d*, . . . , 5*d* of the preceding constituent LED elements 5, 5, . . . , 5, and the respective control output Dout terminals 5*d*, 5*d*, . . . , 5*d* of the constituent LED elements 5, 5, . . . , 5 are being connected in series with the respective control input Din terminals 5*c*, 5*c*, . . . , 5*c* of the succeeding constituent LED elements 5, 5, . . . , 5. Within each of the four constituent displaying groups 101, 102, 103, and 104 in the displaying section 10, since the constituent LED elements 5, 5, . . . , 5 are being connected together in series in the foregoing manner, the respective built-in light emission controlling elements 7, 7, . . . , 7 of those constituent LED elements 5, 5, . . . , 5 are each being connected across each of those constituent LED elements 5, 5, . . . , 5, to be able to carry out a control of respective light emissions of those constituent LED elements with a serial communication. The serial communication (serial control) refers to a communication method designed to serially transmit data one bit at a time in a transmission path in an electric communication. In the present embodiment, for example, the serial communication enables serial signals Ss such as brightness data, color data (RGB), addresses and the like of those constituent LED elements 5, 5, . . . , 5 to be transmitted with one communication line 51.

As shown in FIG. 2B, in the displaying section 10, the control output Dout terminal 5*d* of the last constituent LED element 5 (LED1-J) of the first constituent displaying group 101 is being connected to the control input Din terminal 5*c* of the first constituent LED element 5 (LED2-1) of the second constituent displaying group 102. The same applies to the connection between the second constituent displaying group 102 and the third constituent displaying group 103, and the connection between the third constituent displaying group 103 and the fourth constituent displaying group 104. This enables the controlling section 40 to use the one communication line 51 to input the serial communication control signal Ss output from the controlling section 40 to the control input Din terminal 5*c* of the first constituent LED element 5 (LED1-1) of the first constituent displaying group 101 in the displaying section 10, and thereby pass that input serial communication control signal Ss to the second constituent displaying group 102, the third constituent displaying group 103, and the fourth constituent displaying group 104 in turn.

It should be noted that the serial communication can also be applied to displaying elements other than those constituent LED elements 5, 5, . . . , 5. The serial communication can be applied to displaying elements each equipped with a respective built-in light emission controlling element, and designed to be able to carry out a control of respective light emissions of those displaying elements with the serial communication (serial control).

Power Supplying Section 20

The power supplying section 20 is being configured as one with the allowable value (full capacity) of the output of the power supply being preset. This allowable value of the output of the power supply is defined as the total value of the respective maximum usable electric power values of the four constituent displaying groups 101, 102, 103, and 104 of the displaying section 10.

Here, the maximum electric power consumption of each of the four constituent displaying groups 101, 102, 103, and 104 of the displaying section 10 is denoted by Wmax. The maximum electric power consumption Wmax is defined as the electric power consumption with all the constituent LED elements 5, 5, . . . , 5 within each of the four constituent displaying groups 101, 102, 103, and 104 of the displaying section 10 being fully lit and all the respective built-in light emission controlling elements (control ICs) 7, 7, . . . , 7 of those constituent LED elements 5, 5, . . . , 5 being turned on. Further, the minimum electric power consumption of each of the four constituent displaying groups 101, 102, 103, and 104 of the displaying section 10 is denoted by Wmin. The minimum electric power consumption Wmin is defined as the electric power consumption with all the constituent LED elements 5, 5, . . . , 5 within each of the four constituent displaying groups 101, 102, 103, and 104 of the displaying section 10 being fully unlit and all the respective built-in light emission controlling elements (control ICs) 7, 7, . . . , 7 of those constituent LED elements 5, 5, . . . , 5 being turned on.

The allowable value (full capacity) of the power supply output from the power supplying section 20 is defined as the total value of the respective maximum usable electric power values of the four constituent displaying groups 101, 102, 103, and 104 of the displaying section 10. When the number of the constituent displaying groups of the displaying section 10 is denoted by n, the allowable value (full capacity) of the power supply output from the power supplying section 20 is n·Wmax. Since all the constituent LED elements 5, 5, . . . , 5 within the nth constituent displaying group are operated in the full power operating mode at a power supply startup in the recovery operation after an abnormal operation, the constituent displaying groups other than the nth constituent displaying group whose constituent LED elements 5, 5, . . . , 5 are all fully lit are driven with the above described minimum electric power consumption Wmin. For the constituent displaying groups (the (n−1)th constituent displaying group, . . . , the first constituent displaying group) before the nth constituent displaying group, their abnormal codes within the light emission controlling elements 7, 7, . . . , 7 in those (n−1)th, . . . , first constituent displaying groups have already been able to be overwritten, so those (n−1)th, . . . , first constituent displaying groups are in a controllable state. As a result, the required electric power required for the power supplying section 20 is Wmax+(n−1)·Wmin. Configuring the constituent displaying groups other than the nth constituent displaying group to be driven with the minimum electric power consumption Wmin in the foregoing manner is referred to as a control output minimizing command.

Here, a comparison between Wmax+(n−1)·Wmin, the electric power required for the power supplying section 20 at the power supply startup, and n·Wmax, the allowable value (full capacity) of the power supply output of the power supplying section 20 is made. When n is an integer of not smaller than 1, Wmax+(n−1)·Wmin−n·Wmax can be rewritten into (n−1)·(Wmin−Wmax), and this value becomes a negative number. That is, it can be seen that the electric power required for the power supplying section 20 at the power supply startup is smaller than the allowable value (full capacity) of the power supply output of the power supplying section 20.

As a result, even if the maximum consumed electric power is reached during the recovering operation from an abnormal operation, the power supply capacity falls within the allowable range, so the abnormal codes can be overwritten per constituent displaying group unit. Therefore, at the power supply startup in the recovery operation after the abnormal operation, the abnormal codes within the light emission controlling elements (control ICs) 7, 7, . . . , 7 in each of the four constituent displaying groups 101, 102, 103, and 104 of the displaying section 10 can be overwritten and reset without a voltage drop and the like being caused by a shortage of the power supply capacity. As a result, the power supply recovering operation after the abnormal operation can securely be performed.

Further, since the allowable value (full capacity) of the power supply output of the power supplying section 20 may be set as the total value of the respective maximum usable electric power values of the four constituent displaying groups 101, 102, 103, and 104 of the displaying section 10, and no large capacity power supply, which allows for the power supply recovering operation, may be provided, it is possible to minimize the allowable value (the power supply capacity) of the output of the power supplying section 20, and it is possible to thereby allow a lowering in cost as well.

Switching Sections 31, 32, 33, 34

The switching sections 31, 32, 33, and 34 are each being configured in such a manner as to use a respective static relay to make or break connections between each of the four constituent displaying groups 101, 102, 103, and 104 in the displaying section 10 and the power supplying section 20. The static relays used in the switching sections 31, 32, 33, and 34 are ones which do not have a mechanical movable part such as a contact part, and whose interiors are configured with a semiconductor/electronic component such as a thyristor, a TRIAC, a MOSFET or the like, to electronically turn a signal, or an electric current/voltage on or off through the operation of those electronic circuits.

The switching sections 31, 32, 33, and 34 are on/off controlled by switch control signals S1, S2, S3, and S4 (see FIG. 1), respectively, input from the controlling section 40. It should be noted that although, in FIG. 1, the switching sections 31, 32, 33, and 34 are depicted as switches each having a mechanical contact, these switches are schematically depicted ones, but, in practice, are ones each using a non-contact switch.

Controlling Section 40

The controlling section 40 is being configured to, when the power supplying section 20 is powered on, enable the switching sections 31, 32, 33, and 34 to connect the displaying groups 101, 102, 103, and 104 to the power supplying section 20, and carry out a decision making as to whether the allowable value of the output from the power supplying section 20 is normal or not. It should be noted that since the controlling section 40 is being configured to perform the foregoing decision making by an electric current monitoring with an ammeter 50 (see FIG. 1), it is possible to perform the foregoing decision making by converting the value of the output from the power supplying section 20 into an electric current value, on the basis of the above described allowable value (full capacity) of the power supply output which is the electric power value. The controlling section 40 is being configured to monitor the electric current value I (see FIG. 1) output from the power supplying section 20, and carry out the above described decision making as to whether the allowable value of the output from the power supplying section 20 is normal or not, on the basis of that monitored electric current value I. As a result of the foregoing decision making, if the controlling section 40 determines that the output value (the electric current value I) from the power supplying section 20 is normal, then the controlling section 40 carries out such a control of the connections between the power supplying section 20 and each of the four constituent displaying groups 101, 102, 103, and 104 in the displaying section 10 as to enable the switching sections 31, 32, 33, and 34 to in turn connect supplies of the electric power from the power supplying section 20 to the four constituent displaying groups 101, 102, 103, and 104, respectively, of the displaying section 10.

The monitoring of the electric current value I can be performed with the ammeter 50. Examples of the ammeter 50 to be able to be used include a CT type electric current sensor, that is designed to measure the electric current value I by arranging a magnetic core around a power supply line 52 (see FIG. 1) supplied from the power supplying section 20 to each of the four constituent displaying groups 101, 102, 103, and 104 in the displaying section 10, and converting the measured electric current in the secondary winding of the magnetic core into a secondary electric current in proportion to the winding ratio, or a Hall element type electric current sensor, that is designed to utilize the Hall effect to convert a magnetic field created around the measured electric current into a voltage, or the like.

The controlling section 40 is, for example, a microcomputer, which is configured in such a manner as to be composed of a CPU (Central Processing Unit), which is configured to carry out detection, determination, decision making, and so on, on the basis of acquired data according to a stored program, a RAM (Random Access Memory), which is a semiconductor memory, and a ROM (Read Only Memory), and so on.

The RAM is used, for example, as a storage region for temporarily storing calculation results and the like. The ROM is being configured in such a manner as to store, for example, a program for operating the controlling section 40, an output allowable threshold value Iref to be looked up when carrying out the above described decision making as to whether the allowable value of the output from the power supplying section 20 is normal or not, and so on.

LED Driving Device Recovering Operation after an Abnormal Operation

Figure 3:
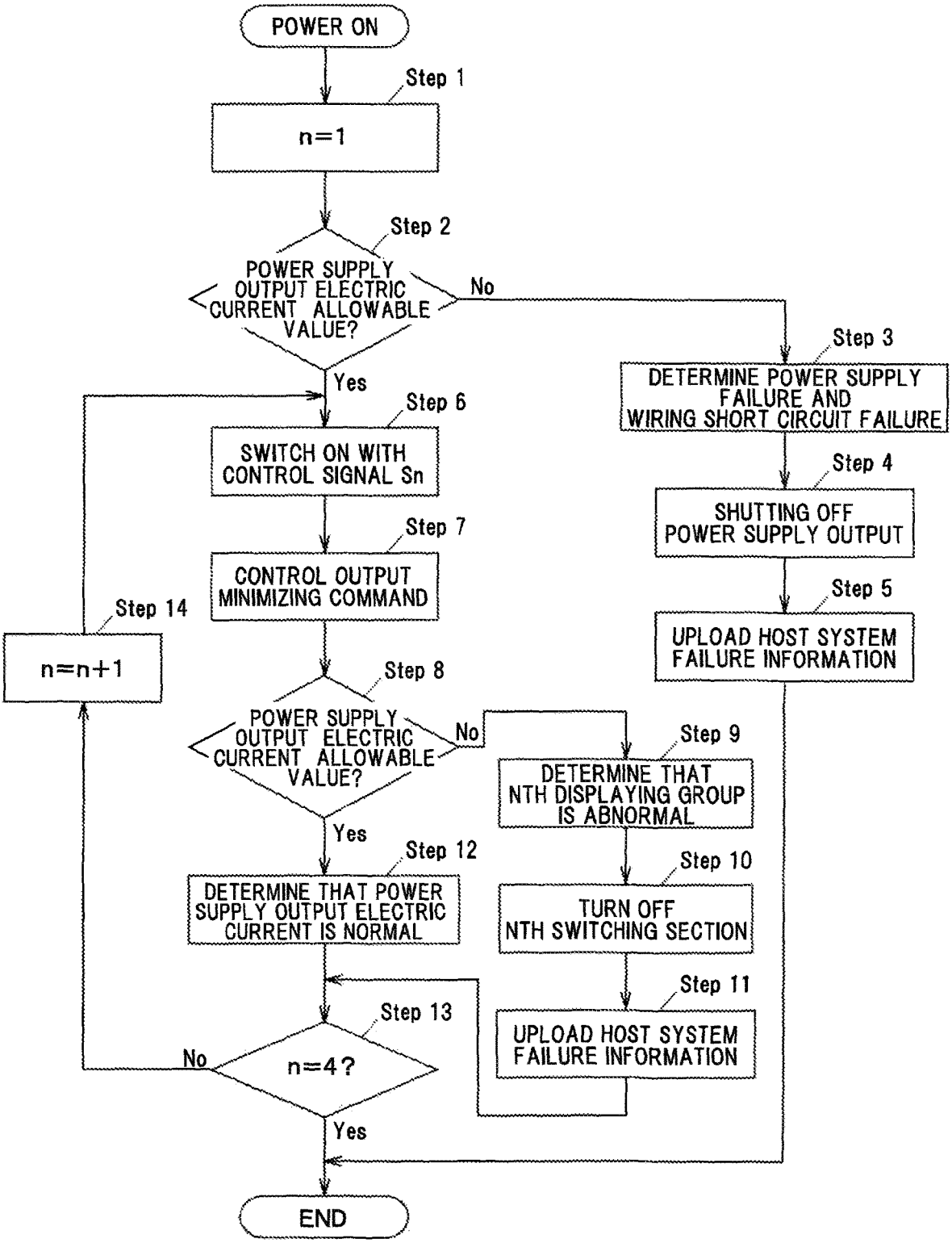
FIG. 3 is a flow chart showing a recovery operation after an abnormal operation of the LED driving device according to the embodiment of the present invention.

FIG. 3 is a flow chart showing a recovery operation after an abnormal operation of the LED driving device 1 according to the embodiment of the present invention, and the LED driving device 1 recovering operation will be described for each step to be executed in accordance with this flow chart.

Step 1

When an abnormal operation of the LED driving device is followed by the power supply being powered on, the controlling section 40 first sets the number n denoting the nth constituent displaying group of the displaying section 10 as n=1 so as to connect the power supply to the first constituent displaying group 101. As a result, the controlling section 40 sends out the switch control signal S1 to the first switching section 31, to make connection between the power supply 20 and the first constituent displaying group 101.

Step 2

The controlling section 40 makes a decision as to whether the electric current value I output from the power supplying section 20 is not larger than the output allowable threshold value Iref. If the electric current value I is not larger than the output allowable threshold value Iref, then the flow progresses to Step 6 (Step 2: Yes), or if the electric current value I is larger than the output allowable threshold value Iref (Step 2: No), then the flow progresses to Step 3.

Steps 3, 4, 5

The controlling section 40 determines that a power supply failure and a wiring short circuit failure have occurred (Step 3), and carries out power supply output shutting off (Step 4), and uploads host system failure information (Step 5). After carrying out the processing in Step 5, the controlling section 40 ends the recovering operation for the LED driving device 1.

Step 6

The controlling section 40 turns on the nth switching section with the switch control signal Sn. It should be noted that when the number n denoting the nth constituent displaying group of the displaying section 10 is set as n=1, the first switching section 31 has already been turned on. When the number n denoting the nth constituent displaying group of the displaying section 10 is set as n=2 to 4, the nth switching section, the (n−1)th switching section, . . . , the first switching section 31 are turned on.

Step 7

The controlling section 40 carries out the control output minimizing command with the serial signal Ss. That is, the controlling section 40 configures the constituent displaying groups other than the nth constituent displaying group to be driven with the minimum electric power consumption Wmin. As a result, the controlling section 40 renders the output states of all the constituent LED elements 5, 5, . . . , 5 of the constituent displaying groups other than the nth constituent displaying group fully unlit, and sends out the serial signal Ss that turns on all the respective built-in light emission controlling elements (control ICs) 7, 7, . . . , 7 of those constituent LED elements 5, 5, . . . , 5. It should be noted that when the number n denoting the nth constituent displaying group of the displaying section 10 is set as n=2 to 4, the controlling section 40 configures the (n−1)th displaying group, . . . , the first constituent displaying group 101 to be driven with the minimum electric power consumption Wmin.

Step 8

The controlling section 40 carries out the decision making as to whether the allowable value of the output from the power supplying section 20 is normal or not. The controlling section 40 is able to perform the foregoing decision making, depending on whether the electric current value I measured by the ammeter 50 is not exceeding the output allowable threshold value Iref. If the electric current value I is not exceeding the output allowable threshold value Iref, then the flow progresses to Step 12 (Step 8: Yes), or if the electric current value I is exceeding the output allowable threshold value Iref (Step 8: No), then the flow progresses to Step 9.

Steps 9, 10, 11

The controlling section 40 determines that the nth constituent displaying group is abnormal (Step 9), turns off the nth switching section for the nth constituent displaying group (Step 10), and uploads the host system failure information (Step 11). After carrying out the processing in Step 11, the flow progresses to Step 13.

Step 12

The controlling section 40 determines that the electric current value I is normal, that is, the allowable value of the output from the power supplying section 20 is normal.

Step 13

The controlling section 40 makes a decision as to whether the number n denoting the nth constituent displaying group of the displaying section 10 is n=4 or not. That is, the controlling section 40 makes a decision as to whether or not the above described steps of determining that the allowable value of the output from the power supplying section 20 is normal have been finished up to the fourth constituent displaying group 104. If the number n denoting the nth constituent displaying group of the displaying section 10 is n=4 (Step 13: Yes), then the controlling section 40 ends the recovering operation for the LED driving device 1, or if the number n denoting the nth constituent displaying group of the displaying section 10 is not n=4 (Step 13: No), then the flow progresses to Step 14.

Step 14

The controlling section 40 sets the number n denoting the nth constituent displaying group of the displaying section 10 as n=n+1, and the flow returns to Step 6.

Steps 6 to 13

The controlling section 40 iteratively executes Steps 6 to 13. As a result, if the controlling section 40 determines that the allowable value of the output from the power supplying section 20 is normal, then the controlling section 40 carries out such a control of the connections between the power supplying section 20 and each of the four constituent displaying groups 101, 102, 103, and 104 in the displaying section 10 as to enable the switching sections 31, 32, 33, and 34 to in turn connect supplies of the electric power from the power supplying section 20 to the four constituent displaying groups 101, 102, 103, and 104, respectively, of the displaying section 10. By iteratively executing Steps 6 to 13, the overwrites of the abnormal codes in the light emission controlling elements 7, 7, . . . , 7 within each of the four constituent displaying groups 101, 102, 103, and 104 of the displaying section 10 in turn are carried out.

By the recovery operation after the abnormal operation of the LED driving device 1 described above, when n=1, the first constituent displaying group 101 is recovered, when n=2, the second constituent displaying group 102 is recovered, when n=3, the third constituent displaying group 103 is recovered, and when n=4, the fourth constituent displaying group 104 is recovered. In this manner, all the four constituent displaying groups 101, 102, 103, and 104 of the displaying section 10 are recovered.

With the use of the recovery algorithm for recovery from the abnormal operation described above, the power supplying section 20 recovers to normal, while the abnormal codes in all the light emission controlling elements 7, 7, . . . , 7 within each of the four constituent displaying groups 101, 102, 103, and 104 of the displaying section 10 can be overwritten and reset. This renders all the four constituent displaying groups 101, 102, 103, and 104, i.e., the displaying section 10 constituted by the four constituent displaying groups 101, 102, 103, and 104 normally operational. Therefore, by controlling the respective brightness, RGB, and the like of each LED element 5 constituting each of the four constituent displaying groups 101, 102, 103, and 104 in the displaying section 10 on the basis of the serial communication control signal Ss output from the controlling section 40 to the displaying section 10, it is possible to display any moving image, any still image, and the like on the entire displaying section 10.

Advantageous Effects of the Embodiments

The LED driving device 1 according to the embodiment of the present invention has advantageous effects as described below.

(1) The LED driving device 1 according to the present embodiment is being configured in such a manner as to include therein the displaying section 10, which is being configured in such a manner as to include therein a plurality (in the present embodiment, four) of the constituent displaying groups 101, 102, 103, and 104, each of which is composed of a respective plurality of the connected LED elements 5, 5, . . . , 5, each of which is being configured in such a manner as to include the respective built-in light emission controlling element 7 therein, so that the plurality of constituent displaying groups 101, 102, 103, and 104 form a display region, the power supplying section 20, which is being configured to provide a supply of an electric power to the displaying section 10, the switching sections 31, 32, 33, and 34, which are being configured to selectively make or break connections between the power supplying section 20 and the plurality of constituent displaying groups 101, 102, 103, and 104, respectively, of the displaying section 10, and the controlling section 40, which is being configured to make a decision as to whether, when the power supplying section 20 is powered on, the allowable value of the output from the power supplying section 20 is normal or not, and as a result of determining that the allowable value of the output from the power supplying section 20 is normal, carry out such a control of the connections between the power supplying section 20 and the plurality of constituent displaying groups 101, 102, 103, and 104 of the displaying section 10 as to enable the switching sections 31, 32, 33, and 34 to in turn connect supplies of the electric power from the power supplying section 20 to the plurality of constituent displaying groups 101, 102, 103, and 104, respectively, of the displaying section 10. Since the LED driving device 1 is being configured in such a manner as to, in the recovery operation after the abnormal operation, in turn connect the supplies of the electric power from the power supplying section 20 to the plurality of constituent displaying groups 101, 102, 103, and 104, respectively, of the displaying section 10, there is no problem with a voltage drop and the like due to a shortage of the capacity of the power supplying section 20.

(2) By setting the allowable value (full capacity) of the power supply output of the power supplying section as the total value of the respective maximum usable electric power values of the four constituent displaying groups 101, 102, 103, and 104 of the displaying section 10, no large capacity power supply, which allows for the power supply recovering operation, may be provided, and therefore it is possible to minimize the allowable value (the power supply capacity) of the output of the power supplying section 20, and it is possible to thereby allow a lowering in cost as well.

(3) In addition, since the recovery operations for the four constituent displaying groups 101, 102, 103, and 104 in turn are performed, it is possible to minimize the size of the power supplying section 20, and further since the capacities of the switching sections 31, 32, 33, and 34 also become small, it is possible to make the LED driving device 1 smaller in size than a circuit that performs the recovery operation with a conventional single large size power supply.

(4) In addition, when the electric current in the event of an abnormal operation has been detected, it is possible to instantaneously shut off the electric current to the load, and it is therefore possible to minimize the electric current capacity.

Although the embodiments of the present invention have been described above, the present invention is not limited to the above-described embodiments, but various modifications can be carried out without departing from the spirit of the invention. In addition, the above embodiments are not to be construed as limiting the inventions according to the appended claims. In addition, it should be noted that not all the combinations of the features described in the embodiments are indispensable to the means for solving the problem of the invention.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

REFERENCE SIGNS LIST

1 LED DRIVING DEVICE
5 LED ELEMENT
7 LIGHT EMISSION CONTROLLING ELEMENT
10 DISPLAYING SECTION
20 POWER SUPPLYING SECTION
31, 32, 33, 34 SWITCHING SECTION
40 CONTROLLING SECTION
101, 102, 103, 104 DISPLAYING GROUP

The invention claimed is:

1. An LED driving device, comprising:

a displaying section configured in such a manner as to include a plurality of displaying groups therein, each of which includes a respective plurality of connected LED elements, each of which is being configured in such a manner as to include a respective built-in light emission controlling element therein, so that the plurality of constituent displaying groups form a display region;

a power supplying section configured to provide a supply of an electric power to the displaying section;

switching sections configured to selectively make or break connections between the power supplying section and the plurality of constituent displaying groups, respectively, of the displaying section; and a controlling section configured to make a decision as to whether, when the power supplying section is powered on, an output value from the power supplying section is normal or not, and as a result of determining that the output value from the power supplying section is normal, carry out such a control of the connections between the power supplying section and the plurality of constituent displaying groups of the displaying section as to enable the switching sections to in turn connect supplies of the electric power from the power supplying section to the plurality of constituent displaying groups, respectively, of the displaying section, wherein the controlling section is configured to monitor an electric current value output from the power supplying section by an ammeter, and to make the decision as to whether, when the power supplying section is powered on, the output value from the power supplying section is normal or not, on a basis of the electric current value monitored by the ammeter iteratively for each of the plurality of constituent displaying groups, respectively, and wherein the controlling section is configured to carry out the control of connections between the power supplying section and the plurality of constituent displaying groups of the displaying section, in a recovery operation after an abnormal operation of the displaying section, in sequence for each of the plurality of constituent displaying groups, respectively.

2. The LED driving device according to claim 1, wherein an allowable value of a power supply output from the power supplying section is set as a total value of respective maximum usable electric power values of the plurality of constituent displaying groups of the displaying section.

3. The LED driving device according to claim 1, wherein the respective pluralities of constituent LED elements of the plurality of displaying groups in the displaying section are being configured in such a manner that the respective built-in light emission controlling elements of the constituent LED elements are each being connected across each of the constituent LED elements, to carry out a control of respective light emissions of the constituent LED elements with a serial communication.

4. The LED driving device according to claim 1, wherein the switching sections are being configured in such a manner as to use static relays, respectively, to selectively make or break the connections between the plurality of constituent displaying groups, respectively, of the displaying section and the power supplying section.

5. The LED driving device according to claim 1, wherein a switching section of the switching sections connects or disconnects the supplies of the electric power from the power supplying section to the respective plurality of connected LED elements of the each of the displaying groups.

6. The LED driving device according to claim 5, wherein each of the respective plurality of connected LED elements of the each of the displaying groups is directly connected to a switching section of the switching sections.

7. The LED driving device according to claim 5, wherein the respective plurality of connected LED elements of the each of the displaying groups are connected in parallel to the switching section of the switching sections.

8. The LED driving device according to claim 7, wherein the respective plurality of connected LED elements of the each of the displaying groups are connected in series to each other.

9. The LED driving device according to claim 5, wherein the switching section of the switching sections comprises a static relay coupled to the power supplying section and a displaying group of the displaying groups.

10. The LED driving device according to claim 5, wherein the switching section of the switching sections comprises a static relay that is directly connected to the power supplying section and further is directly connected to the respective plurality of connected LED elements of a displaying group of the displaying groups.

11. The LED driving device according to claim 5, wherein the power supplying section supplies a same output value to the switching section of the switching sections and to the controlling section.

12. The LED driving device according to claim 1, wherein the controlling section is configured to determine whether the output value from the power supplying section is normal or not, by determining whether the electric current value monitored by the ammeter is above a predetermined threshold, iteratively for each of the plurality of constituent displaying groups, respectively.

13. The LED driving device according to claim 1, wherein the controlling section is configured to determine whether an allowable value of an output from the power supplying section is normal or not, by comparing whether the electric current value monitored by the ammeter exceeds an allowable threshold value, iteratively for each of the plurality of constituent displaying groups, respectively, during a recovery operation after abnormal operation of the LED driving device.

14. An LED driving device, comprising:

a displaying section configured in such a manner as to include a plurality of displaying groups therein, each of which includes a respective plurality of connected LED elements, each of which is being configured in such a manner as to include a respective built-in light emission controlling element therein, so that the plurality of constituent displaying groups form a display region;

a power supplying section configured to provide a supply of an electric power to the displaying section;

switching sections configured to selectively make or break connections between the power supplying section and the plurality of constituent displaying groups, respectively, of the displaying section; and a controlling section configured to make a decision as to whether, when the power supplying section is powered on, an output value from the power supplying section is normal or not, and as a result of determining: that the output value from the power supplying section is normal, carry out such a control of the connections between the power supplying section and the plurality of constituent displaying groups of the displaying section as to enable the switching sections to in turn connect supplies of the electric power from the power supplying section to the plurality of constituent displaying groups, respectively, of the displaying section, wherein the controlling section is configured to monitor an electric current value output from the power supplying section by an ammeter, and to make the decision as to whether, when the power supplying section is powered on, the output value from the power supplying section is normal or not, on a basis of the electric current value monitored by the ammeter iteratively for each of the plurality of constituent displaying groups, respectively, wherein the controlling section is configured to determine whether the output value from the power supplying section is normal or abnormal, by determining whether the electric current value monitored by the ammeter exceeds an allowable threshold value, iteratively for each of the plurality of constituent displaying groups to overwrite abnormal codes, until each of the plurality of constituent display groups are recovered to a normal operation after initially determining abnormal operation of any of plurality of constituent display groups.

15. The LED driving device according to claim 14, wherein an allowable value of a power supply output from the power supplying section is set as a total value of respective maximum usable electric power values of the plurality of constituent displaying groups of the displaying section.

16. The LED driving device according to claim 14, wherein the respective pluralities of constituent LED elements of the plurality of displaying groups in the displaying section are being configured in such a manner that the respective built-in light emission controlling elements of the constituent LED elements are each being connected across each of the constituent LED elements, to carry out a control of respective light emissions of the constituent LED elements with a serial communication.

17. The LED driving device according to claim 14, wherein the switching sections are being configured in such a manner as to use static relays, respectively, to selectively make or break the connections between the plurality of constituent displaying groups, respectively, of the displaying section and the power supplying section.

18. The LED driving device according to claim 14, wherein the controlling section is being configured to carry out the control of the connections between the power supplying section and the plurality of constituent displaying groups of the displaying section, in a recovery operation after an abnormal operation of the displaying section.

19. The LED driving device according to claim 14, wherein a switching section of the switching sections connects or disconnects the supplies of the electric power from the power supplying section to the respective plurality of connected LED elements of the each of the displaying groups.

20. The LED driving device according to claim 14, wherein the controlling section is configured to determine whether the output value from the power supplying section is normal or not, by determining whether the electric current value monitored by the ammeter is above a predetermined threshold, iteratively for each of the plurality of constituent displaying groups, respectively.

* * * * *